United States Patent [19]

Lund

[11] Patent Number: 4,784,398

[45] Date of Patent: Nov. 15, 1988

[54] CORE LIFTING CHUCK

[76] Inventor: Arnold M. Lund, 1210 Avocado Ave., Escondido, Calif. 92026

[21] Appl. No.: 50,336

[22] Filed: May 18, 1987

[51] Int. Cl.[4] ..... B66C 1/54

[52] U.S. Cl. ..... 279/2 R; 294/93; 294/97

[58] Field of Search ..... 279/2 R; 242/58.6; 294/93, 97

[56] References Cited

U.S. PATENT DOCUMENTS

| | | | |
|---|---|---|---|
| 2,610,888 | 9/1952 | Pace | 294/93 |
| 2,809,070 | 10/1957 | Nelson | 294/93 X |
| 2,951,725 | 9/1960 | St. Jean | 294/97 |
| 4,199,183 | 4/1980 | Hecker | 294/97 |

FOREIGN PATENT DOCUMENTS

| | | | |
|---|---|---|---|
| 692450 | 8/1964 | Canada | 294/97 |
| 2556330 | 6/1985 | France | 294/97 |

OTHER PUBLICATIONS

Nim-Cor V.C.L./Duo-Grip V.C.L. 1 page advertisement, Mar. 1985.

Tilt-Lock Spool Lifter-1 page adv. (date unknown).

Tilt-Lock Bulletin #501A, 4 page brochure (date unknown).

*Primary Examiner*—Gil Weidenfeld

*Assistant Examiner*—Steven C. Bishop

*Attorney, Agent, or Firm*—Baker, Maxham & Jester

[57] ABSTRACT

An expandable chuck for insertion into a vertically oriented, longitudinally extending, cylindrical hollow core about which a web of paper or other material is wound to form a roll. An elongate body is dimensioned for insertion into the core. Mechanisms are connected to an upper portion of the body for engaging an upper end of the core to prevent the body from falling down through the core. A central lifting post is mounted to the body for vertical reciprocation relative thereto between a lowered position and a raised position. A plurality of jaws are connected by a linkage between the central lifting post and a lower portion of the body for movement from retracted positions in which they are disengaged from an inner surface of the core to extended positions in which they are grippingly engaged with the inner surface of the core. The jaws move from their retracted positions to their extended positions upon movement of the central lifting post from its lowered position to its raised position. The jaws extend radially from the body at equally circumferentially spaced locations. Hardware is connected to an upper end of the central lifting post for connecting thereto a hook or other connecting mechanism of an overhead crane. Hoisting of the hook with the crane will move the central lifting post to its raised position thereby grippingly engaging the jaws with the inner surface of the core. The roll can thus be lifted with the chuck. The chuck can thereafter be readily removed from the core by manually lifting the upper end engagement means to allow the central lifting post to move under the force of gravity to its lowered position, thereby disengaging the jaws from the inner surface of the core.

8 Claims, 1 Drawing Sheet

FIG. 1
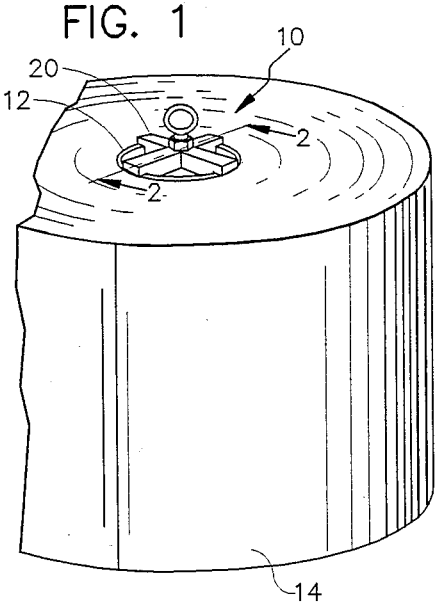
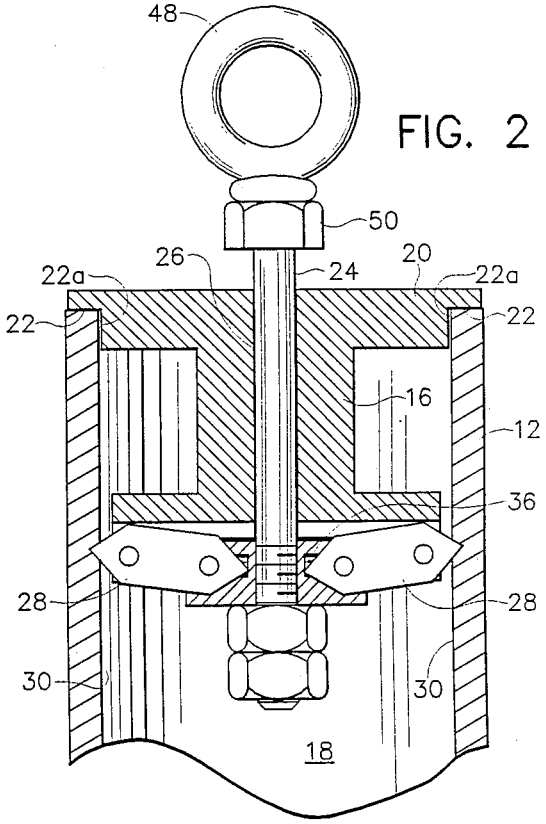
FIG. 2
FIG. 3
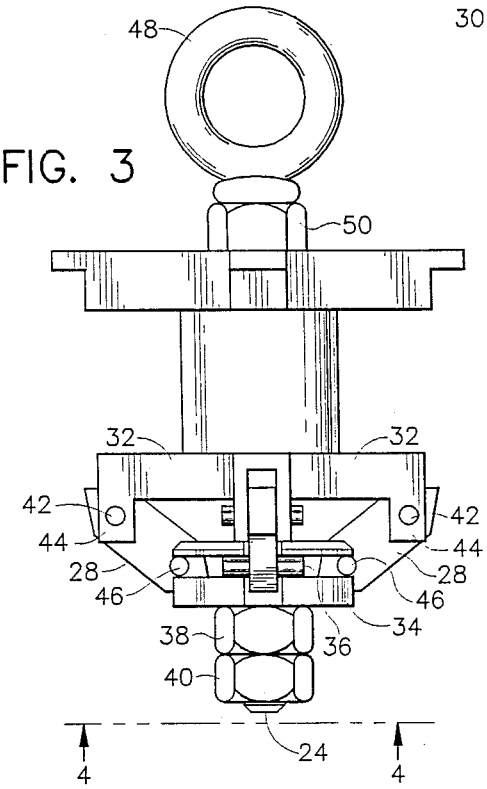
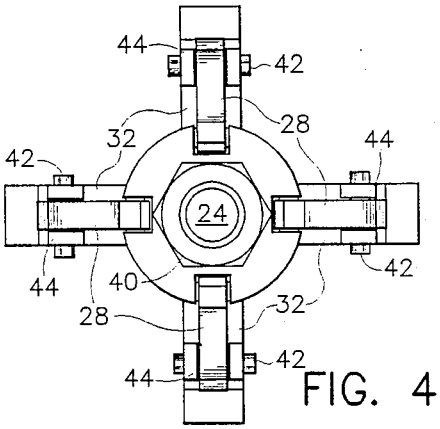
FIG. 4

CORE LIFTING CHUCK

BACKGROUND OF THE INVENTION

The present invention relates to mechanical chucks, and more particularly, to a chuck of the expandable type for lifting heavy rolls of paper or other web material upon insertion into the central core thereof.

Large webs of paper, plastic film, or other material used in printing, packaging, etc. are typically wound about central hollow cylindrical fiber or cardboard cores. The rolls may weigh five hundred pounds or more and are stored vertically in warehouses. Mechanisms are required for quickly securing the rolls to an overhead crane, hoist, monorail system or other transport system so that such large rolls can be moved.

Tilt-Lock, Inc. sells a variety of roll and coil lifting devices. They are inserted vertically into the core and have manual or automatic mechanisms that engage teeth with the core. The manual device is engaged with a twist knob. The automatic devices use solenoids and/or suction. At least one of the devices has a gravity activated mechanical lock-up and release mechanism.

Two more commercially available core lifting chucks are the Nim-Cor V.C.L. and the Duo-Grip V.C.L. They each include a pair of stepped, opposing, half-cylinder elongated jaws that are expanded into gripping engagement with the interior of a core by a lever mechanism.

Tilt-Lock, Inc. also sells a spool lifting device for wooden or other larger spools that carry cable, etc. It has a single angled tooth that is manually retracted to allow insertion into the central hole of the spool. The tooth thereafter expands to engage the inside surface of a perpendicularly extending circular side piece of the spool. This device does not appear to be suitable for gripping the inside of a cardboard core.

While the foregoing devices are each functional, I believe that I have invented an improved core lifting chuck which is more compact, less complex and simpler to engage and disengage.

SUMMARY OF THE INVENTION

The present invention provides an expandable chuck for insertion into a vertically oriented, longitudinally extending, cylindrical hollow core about which a web of paper or other material is wound to form a roll. An elongate body is dimensioned for insertion into the core. Means, such as crossbars, are connected to an upper portion of the body for engaging an upper end of tee core to prevent the body from falling down through the core. A central lifting post is mounted to the body for vertical reciprocation relative thereto between a lowered position and a raised position. A plurality of jaws are connected by a linkage between the central lifting post and a lower portion of the body for movement from retracted positions in which they are disengaged from an inner surface of the core to extended positions in which they are grippingly engaged with the inner surface of the core. The jaws move from their retracted positions to their extended positions upon movement of the central lifting post from its lowered position to its raised position. The jaws extend radially from the body at equally circumferentially spaced locations. A lifting ring or other suitable hardware is connected to an upper end of the central lifting post for connecting thereto a hook or other connecting mechanism of an overhead crane. Hoisting of the hook with the crane will move the central lifting post to its raised position thereby grippingly engaging the jaws with the inner surface of the core. The roll can thus be lifted with the chuck. The chuck can thereafter be readily removed from the core by manually lifting the upper end engagement means to allow the central lifting post to move under the force of gravity to its lowered position, thereby disengaging the jaws from the inner surface of the core.

BRIEF DESCRIPTION OF THE DRAWINGS

FIG. 1 is a perspective view illustration a roll of paper with a preferred embodiment of my core lifting chuck inserted in the upper end of its central cardboard core.

FIG. 2 is an enlarged vertical section view illustrating the preferred embodiment of my core lifting chuck inserted in the upper end of a cardboard core with its jaws expanded into gripping engagement with the inner surface of the core.

FIG. 3 is an enlarged side elevation view of the preferred embodiment of my core lifting chuck with its jaws retracted.

FIG. 4 is an bottom end elevation view of the preferred embodiment of my core chuck taken along line 4—4 of FIG. 3 and illustrating the bottom end of the central body, the four jaws and four jaw supporting arms.

DESCRIPTION OF THE PREFERRED EMBODIMENTS

Referring to FIG. 1 an expandable chuck 10 is manually inserted into the upper end of a vertically oriented, longitudinally extending, cylindrical hollow core 12 about which a web of paper or other material is wound to form a roll 14. Referring to FIG. 2, an elongate hollow cylindrical body 16 is dimensioned for insertion into the hollow interior 18 of the core 12. Means, such as crossbars 20 (FIG. 1), are connected to an upper portion of the body for engaging an upper end 22 (FIG. 2) of the core to prevent the body 16 from falling down through the core. The crossbars 20 are each notched at **20*a*** to facilitate centering of the chuck with respect to the core.

A central cylindrical lifting post 24 (FIG. 2) is mounted for vertical reciprocation in an axial bore 26 through the body. The post 24 can reciprocate between a lowered position illustrated in FIG. 3 and a raised position illustrated in FIG. 2. Four identical jaws 28 (FIGS. 2, 3 and 4) are connected between the central lifting post 26 and a lower portion of the body 16 for movement from retracted positions (FIG. 3) in which they are disengaged from an inner surface 30 of the core to extended positions (FIG. 2) in which they are grippingly engaged with the inner surface of the core. The jaws 28 move from their retracted positions to their extended positions upon movement of the central lifting post 26 from its lowered position to its raised position. As best seen in FIG. 4, the four jaws 28 extend radially from the body at equally circumferentially spaced locations.

The lower portion of the body 16 includes four radially extending arms 32 (FIGS. 3 and 4). A circular yoke 34 (FIG. 3) having an annular peripheral slot 36 (FIG. 2) is screwed over the threaded lower end of the lifting post 26. The yoke is held in position by bolts 38 and 40 also screwed over the lower end of the lifting post. An outer end of each of the jaws 28 has an outer pivot pin 42 (FIGS. 3 and 4) therethrough which rotatably connects the same to a downwardly extending trunion portion 44 (FIG. 4) of a corresponding one of the arms 32. An inner end of each of the jaws 28 has an inner pivot pin 46 (FIG. 3) therethrough which slides in the annular slot 36 of the yoke 34. Thus the foregoing structure provides a linkage means so that up and down movement of the central lifting post 24 extends the sharp outer ends of the jaws 28 into gripping or biting engagement with the inner wall 30 of the cardboard core.

A lifting ring 48 (FIGS. 2 and 3) or other suitable hardware is connected to an upper end of the central lifting post 24 by a bolt 50 for connecting thereto a hook or other connecting mechanism of an overhead crane. Hoisting of the hook with the crane will move the central lifting post to its raised position thereby grippingly engaging the jaws with the inner surface of the core. The roll can thus be lifted with the chuck. The chuck can thereafter be readily removed from the core by manually grasping the cross bars 20 and lifting. This allows the central lifting post 24 to descend under the force of gravity to its lowered position, thereby disengaging the jaws from the inner surface of the core. My core lifting chuck grips concentrically from within the interior of the core. The heavier the roll, and thus the greater the lifting force on the ring 48, the more the pointed ends of the jaws will dig into the core and the stronger the grip will be.

Having described a preferred embodiment of the core lifting chuck it will be apparent that modifications and adaptations will occur to those skilled in the art. There fore the protection afforded my invention should only be limited in accordance with the scope of the following claims:

I claim:

1. An expandable chuck for insertion into a vertically oriented, longitudinally extending, cylindrical hollow core about which a web of paper or other material is wound to form a roll, comprising:

an elongate body dimensioned for insertion into the core;

means connected to an upper portion of the body for engaging an upper end of the core to prevent the body from falling down through the core;

a central lifting post;

means for mounting the post to the body for vertical reciprocation relative thereto between a lowered position and a raised position;

a plurality of jaws;

linkage means for connecting the jaws between the central lifting post and a lower portion of the body for movement from retracted positions in which they are disengaged from an inner surface of the core to extended positions in which they are grippingly engaged with the inner surface of the core, the jaws moving from their retracted positions to their extended positions upon movement of the central lifting post from its lowered position to its raised position, and the jaws extending radially from the body at equally circumferentially spaced locations;

means connected to an upper end of the central lifting post for receiving a hook or other connecting mechanism of an overhead crane;

the lower portion of the body including a plurality of radially extending arms corresponding in number to the number of jaws;

the linkage means including a yoke connected to a lower end of the central lifting post;

means for pivotally connecting an inner end of each of the jaws to the yoke;

means for pivotally connecting an outer end of each of the jaws to an outer end of a corresponding one of the arms;

each arm including a downwardly extending trunion; and the means for connecting the outer ends of each of the jaws including a pivot pin that extends through the outer end of each jaw and is journaled to a corresponding one of the trunions with the jaw pivotable between a pair of segments of the trunion;

whereby hoisting of the hook or other connecting mechanism with the crane will move the central lifting post to its raised position thereby grippingly engaging the jaws with the inner surface of the core and the roll will be lifted with the chuck, and the chuck can thereafter be readily removed from the core by manually lifting the upper end engagement means to allow the central lifting post to move to its lowered position under the force of gravity, thereby disengaging the jaws from the inner surface of the core.

2. A chuck according to claim 1 wherein the lifting post reciprocates in a cylindrical bore through the body.

3. A chuck according to claim 1 wherein the means connected to the upper end of the central lifting post includes a ring.

4. A chuck according to claim 1 wherein there are four jaws.

5. A chuck according to claim 1 wherein the yoke comprises a cylindrical member having a peripheral annular slot formed therein.

6. A chuck according to claim 5 wherein the means for pivotally connecting the inner end of each of the jaws to the yoke includes a second pivot pin extending through the inner end of each jaw and seated in the annular slot in the yoke for radial sliding movement therein.

7. A chuck according to claim 1 wherein the means for engaging the upper end of the core includes a pair of cross-bars connected to the upper portion of the body.

8. A chuck according to claim 7, wherein the outer end of each of the crossbars is notched to engage the upper end of the core to thereby facilitate centering of the chuck with respect to the core.

* * * * *